United States Patent [19]

Leupacher

[11] Patent Number: 5,014,620

[45] Date of Patent: May 14, 1991

[54] DETONATOR/IGNITER ELEMENT WITH BLEACHABLE ABSORBER

[75] Inventor: Wolfgang Leupacher, Menghofen, Fed. Rep. of Germany

[73] Assignee: Dynamit Nobel Aktiengesellschaft, Troisdorf, Fed. Rep. of Germany

[21] Appl. No.: 480,204

[22] Filed: Feb. 14, 1990

[30] Foreign Application Priority Data

Feb. 14, 1989 [DE] Fed. Rep. of Germany ..... 3904276

[51] Int. Cl.[5] ..... F42B 3/113

[52] U.S. Cl. ..... 102/201

[58] Field of Search ..... 102/201

[56] References Cited

U.S. PATENT DOCUMENTS

| | | | |
|---|---|---|---|
| 3,177,651 | 4/1965 | Lawrence | 102/201 |
| 3,362,329 | 1/1968 | Epstein | 102/201 |
| 3,685,392 | 8/1972 | Platt | 102/201 |
| 3,724,383 | 4/1973 | Gallaghan et al. | 102/201 |
| 4,917,014 | 4/1990 | Loughry et al. | 102/201 |

*Primary Examiner*—Charles T. Jordan

*Attorney, Agent, or Firm*—Antonelli, Terry, Stout & Kraus

[57] ABSTRACT

By interposing, in a detonator/igniter (or igniting) element directly initiatable by a laser pulse, a layer of adequate absorbance over the optical spectral region, which layer can be faded out at the wavelength of the detonator laser, into the beam path, then the layer acts as a switch preventing light other than the laser pulse intended for triggering from setting off detonation of a primary charge within the element. The switching function, i.e., the intensity at which a laser pulse is allowed to pass through, depends on the spectral characteristics of the bleachable absorber and should range between $10^7$ and $10^{12}$ W/cm$^2$. The bleachable absorber is a passive element offering considerable protection from erroneous triggering by light other than the intended laser pulse; it can be manufactured and integrated into the element in an inexpensive and controllable way and does not require any substantial raising of the energy of the laser.

7 Claims, 1 Drawing Sheet

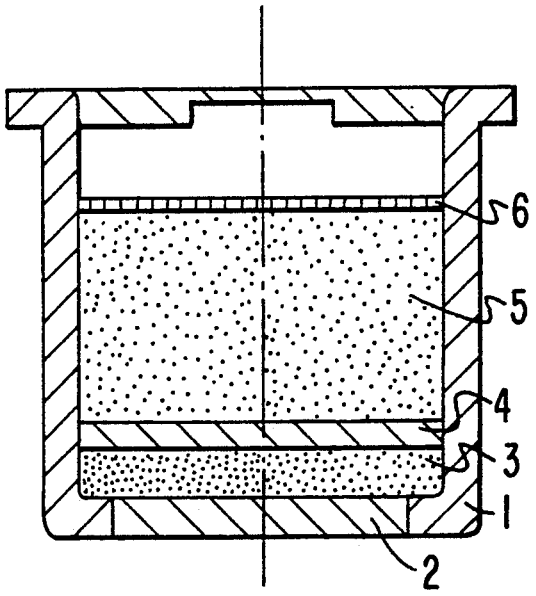
6
5
4
3
1
2

DETONATOR/IGNITER ELEMENT WITH BLEACHABLE ABSORBER

BACKGROUND OF THE INVENTION

This invention is directed to a detonator/igniter element, the explosive charge of which can be initiated directly by laser light.

The direct initiation of detonator elements by means of laser light has been known, for example, from U.S. Pat No. 3,362,329 or U.S. Pat No. 3,724,383. This type of initiation, as compared with electrical triggering is distinguished by a higher insensitivity to disturbances with respect to electrostatic charges, electromagnetic radiation, and also with respect to electromagnetic pulses (EMP) generated by atomic weapons. However, extraneous light, if it is of sufficiently high power density, will also lead to triggering.

In order to preclude initiation by extraneous light, it is possible to install, in case of laser detonator elements, a mechanical or electro-optical switch (Kerr cell, Pockels cell) into the optical path upstream of the charge; this switch opens for only a brief period of time during which a laser pulse is being radiated. However, for this purpose an expensive electronic actuation system is required.

On account of the fact that electrical pulses can be processed and switched more easily than optical ones, another concept provides first an energy conversion of the laser pulse into a electric pulse, and detonation of the primary charge takes place by means of an incandescent bridge (DE 3,342,818-A; DE 3,342,819-A; DE 3,412,798-A). Disadvantages herein are the electronic parts, which are large in number, and the losses occurring during energy conversion and in the switching elements.

SUMMARY OF THE INVENTION

It is an object of the invention to provide a detonator/igniter element which is initiatable directly by laser light, but which is protected against being triggered by extraneous light.

This object as been attained by a detonator/igniter element characterized in that the optical path to the explosive charge can be routed or directed only by way of an absorber capable of fade-out, the absorber being designed so that the light, below an intensity threshold in the range from $10^7$ to $10^{12}$ W/cm$^2$, is weakened to such an extent that this light is incapable of initiating the explosive charge.

Bleachable absorbers, also called saturable absorbers, exhibit an intensity-dependent transmission characteristic. For small light intensities, transmission is approximately constant (starting transmission $T_0$). Starting with a specific intensity threshold $I_S$, transmission increases greatly with the intensity and then proceeds asymtomatically toward a critical value $T_A$ (fade-out transmission) which is relatively large, even assuming a value of 1 in the ideal case. Whether, and in which wavelength region, an absorber is capable of fade-out depends on spectroscopical data, such as lifetime of the excited states and effective cross section for excited state absorption. The entire optical absorption spectrum should be examined with maximum diligence by a person skilled in the art.

A saturable absorber for the specific usage of the present invention should have a starting transmission of smaller than 0.05, $I_S$ should be larger than $10^7$ W/cm$^2$, and $T_A$ should be larger than 0.6 (actual values $0.3 \leqq T_A \leqq 0.95$).

The rise of the transmission above $I_S$ should be maximally steep (substantial rise within one to two powers of ten of the intensity). It is understood that it must be possible to attain, with the laser functioning as detonation generator, intensities in the saturable absorber which lead to fade-out. By a favorable choice of the bleachable absorber and by adapting same to the laser source, it is possible to utilize, for initiating the detonator/igniter element of this invention, a laser flash that is practically no higher in energy than would be required without the bleachable absorber.

In order to be able to select the intensity threshold $I_S$ to be high, and yet to attain complete fade out of the saturable absorber, the laser triggering the detonation should be connected in Q-switched mode or be phase-coupled. The pulse duration of the laser flash then lies below 200 ns. For increasing the intensity, the laser pulses can also be additionally focused.

The special advantage of this detonator/igniter element according to the invention resides in the extreme insensitivity to disturbances. A bleachable absorber is a very compact, passive optical switching element requiring no external supply or triggering. The operability of this passive switching element is not impaired even by mechanical or thermal loads, and even by the strongest electromagnetic fields. Besides, the manufacture of this detonator/igniter element is simple, inexpensive, and accurately controllable. It is possible to find, practically for any type of laser, substances that are suitable therefor and exhibit an absorption characteristic capable of fade-out attuned to the particular laser.

Suitable materials for absorbers capable of fade-out are, in particular, organic dyes exhibiting a strong basic absorption at the wavelength of the detonator laser. In order to attain a high degree of fading, the absorption away from the excited state (excited state absorption) should be at a minimum. The dyes can be utilized in the form of a solution in a cuvette, the boundary of the cuvette simultaneously assuming the function of an inlet window into the housing of the blasting cap. However, it is also possible to add the dye molecules in the solid form as a layer or as a doping to the material of the inlet window. Examples for bleachable dyes are rhodamine GG, rhodamine B, "DDI" (1,1'-diethyl-2,2'dicarbocyanine iodide), cresyl violet; especially suited for the neodymium laser are the polymethine dyes A 9860 and A 9740.

Also, the classes of substances of the crystals and glasses yield materials for bleachable absorbers. The LiF crystal having the F-center $F_2^-$ is advantageous for the neodymium laser, suitable for the $CO_2$ laser is the KCl crystal having the F-center $ReO_3$. Suitable filter glasses capable of fade-out, such as, for example, neutral glass grey filters or semiconductor glasses, can be found at very many laser wavelengths.

A further increase in passive safety of these detonator/igniter elements can be achieved by additionally blocking the spectral region therein the bleachable absorber has too high a transmission ($T \geqq 3\%$). This can be done by the introduction of filters showing no absorbance, or a very weak absorbance, at the laser wavelength, especially cutoff filters or interference filters, into the beam path upstream or downstream of the bleachable absorber.

BRIEF DESCRIPTION OF DRAWING

A detonator/igniter element according to this invention is illustrated in the accompanying drawing, wherein the sole FIGURE is a schematic cross-sectional view of the element.

DETAILED DESCRIPTION OF THE INVENTION

(SPECIAL EXAMPLE)

Two optical windows 2 and 4 are cast into the steel housing 1. The windows, together with the housing, form a cuvette wherein the interior 3 has a height of 1 mm. A $2\times10^{-4}$- molar dyestuff solution of the polymethine dye A 9860, dissolved in dichloroethane, is filled into this cuvette. This solution exhibits, in the wavelength range from 900 to 1100 nm, a starting transmission $T_0$ of below 5%. At the wavelength of the neodmium laser ($\approx$1060 nm), transmission is even lower than 3%, as long as the laser intensity radiated into the solution is below $10^7$ W/cm$^2$; starting with an intensity of $10^8$ W/cm$^2$, transmission rises greatly and reaches about 85% at $5\times10^9$ W/cm$^2$. The optical spectral region below 900 nm can be additionally blocked off by filters, in this case, for example, by a long bandpass cutoff filter RG 850 or RG 830 (RG: red glass - numbers are specifications of the manufacturer: Schottglasses) as the inlet window 2. The window acting as a bleachable absorber may be crystal or glass. An example of a suitable material is a neutral-grey-glass filter NG1 (Schott) of 1–2 mm thickness which provides sufficient blocking.

A primary charge 5 of lead azide is pressed directly against the rear window 4 made of BK7 glass (borosilicate glass); this charge is covered with a protective film 6 (lead-tin film). Other suitable charge materials are available, e.g., lead styphnate; AZM9531 ($BKNO_3$-mixture); NKP-S-5360; black powder 2K; S.2956 ($B_a[NO_3]_2$ mixture).

A safe detonation takes place if an adequately strong laser pulse from a neodymium laser hits the bleachable dye, bleaches dye, and passes on to the primary element. Extraneous light or incidentally occurring light flashes cannot pass to the primary element, due to the high absorption, and consequently cannot initiate this detonator element. This element may be used in many different applications; the laser beam may be coupled in by a mirror-system, by an optical fiber, or be focused by a lens system.

What is claimed is:

1. A detonator/igniter element which comprises a housing containing an explosive charge which can be initiated directly by laser light, and means for defining an optical path to said explosive charge, said means comprising a bleachable absorber and exhibiting properties such that light below an intensity threshold in the range of from $10^7$ to $10^{12}$ W/cm$^2$ is weakened to such an extent that initiation of the explosive charge by this light is impossible, but initiation of the explosive charge by the laser light is possible.

2. A detonator/igniter element according to claim 1, wherein the explosive charge is within a portion of the housing, and said means for defining an optical path includes a cuvette formed in another portion of the housing, said cuvette being integrated upstream of the explosive charge and containing the absorber which is a liquid capable of fading out.

3. A detonator/igniter element according to claim 1, wherein the explosive charge is accommodated in the housing and the means for defining the optical path includes a window, said window having a thickness and appropriate absorption properties so that the window acts as the bleachable absorber.

4. A detonator/igniter element according to claim 1, wherein a cutoff or interference filter is additionally arranged in the optical path.

5. A detonator/igniter element according to claim 2, wherein a cutoff or interference filter is additionally arranged in the optical path.

6. A detonator/igniter element according to claim 3, wherein a cutoff or interference filter is additionally arranged in the optical path.

7. A detonator/igniter element according to claim 1, wherein the absorber is made of a material selected from the group consisting of an organic dye, a crystal, or a glass, capable of fading out.

* * * * *